US009091426B2

(12) United States Patent
Bell

(10) Patent No.: US 9,091,426 B2
(45) Date of Patent: Jul. 28, 2015

(54) LIGHT ASSEMBLY

(71) Applicant: ABL IP HOLDING LLC, Conyers, GA (US)

(72) Inventor: Larry Michael Bell, Brooks, GA (US)

(73) Assignee: ABL IP Holding LLC, Conyers, GA (US)

( * ) Notice: Subject to any disclaimer, the term of this patent is extended or adjusted under 35 U.S.C. 154(b) by 164 days.

(21) Appl. No.: 13/798,981

(22) Filed: Mar. 13, 2013

(65) Prior Publication Data

US 2013/0258672 A1 Oct. 3, 2013

Related U.S. Application Data

(60) Provisional application No. 61/686,017, filed on Mar. 29, 2012.

(51) Int. Cl.

| | |
|---|---|
| ***F21V 29/00*** | (2006.01) |
| ***F21V 13/04*** | (2006.01) |
| ***F21V 17/00*** | (2006.01) |
| ***F21V 17/12*** | (2006.01) |
| ***F21V 29/74*** | (2015.01) |
| *F21V 19/00* | (2006.01) |
| *F21Y 101/02* | (2006.01) |
| *F21V 29/507* | (2015.01) |

(52) U.S. Cl.

CPC ..... *F21V 29/2206* (2013.01); *F21V 13/04* (2013.01); *F21V 17/002* (2013.01); *F21V 17/12* (2013.01); *F21V 29/74* (2015.01); *F21V 19/003* (2013.01); *F21V 29/507* (2015.01); *F21Y 2101/02* (2013.01); *Y10T 29/4973* (2015.01); *Y10T 29/49815* (2015.01); *Y10T 29/49826* (2015.01)

(58) Field of Classification Search

CPC ..... F21V 29/004; F21V 29/2206; F21V 29/2231; F21V 29/2212; F21V 15/011

USPC ..... 362/294

See application file for complete search history.

(56) References Cited

U.S. PATENT DOCUMENTS

| | | | | |
|---|---|---|---|---|
| 7,654,688 | B2 | 2/2010 | Li et al. | |
| 7,874,711 | B2 | 1/2011 | Green et al. | |
| 7,993,025 | B2 | 8/2011 | Chiu | |
| 8,038,328 | B2 | 10/2011 | Lin et al. | |
| 8,083,383 | B2 | 12/2011 | Chen | |
| 8,096,672 | B2 | 1/2012 | Mandy et al. | |
| 2009/0116251 | A1 * | 5/2009 | Harbers et al. | 362/373 |
| 2010/0026158 | A1 | 2/2010 | Wu | |
| 2010/0259919 | A1 | 10/2010 | Khazi et al. | |
| 2010/0270922 | A1 | 10/2010 | Lin | |
| 2010/0296272 | A1 | 11/2010 | Roos et al. | |
| 2010/0328952 | A1 | 12/2010 | Chen | |
| 2011/0002118 | A1 | 1/2011 | Yip et al. | |

(Continued)

*Primary Examiner* — Anne Hines

(74) *Attorney, Agent, or Firm* — Kilpatrick Townsend & Stockton, LLP

(57) ABSTRACT

A light fixture that allows for customization and easy adjustability of various properties of the distributed light. The light fixture includes a threaded ring that engages with threads of a heat sink to support and retain a lens and/or reflector within the fixture. Because the threaded ring retains the lens and reflector within the fixture, unscrewing the threaded ring allows the lens and/or the reflector to be replaced without having to remove the entire fixture.

16 Claims, 2 Drawing Sheets

(56) References Cited

U.S. PATENT DOCUMENTS

2011/0019402 A1 1/2011 Mo
2011/0121727 A1 5/2011 Sharrah et al.
2011/0194280 A1 8/2011 Ruffin, Jr. et al.
2011/0273889 A1 11/2011 Boomgaarden et al.
2011/0299287 A1 12/2011 Liao
2011/0317428 A1 12/2011 Paik et al.

* cited by examiner

LIGHT ASSEMBLY

CROSS-REFERENCE TO RELATED APPLICATION

This application claims the benefit of U.S. Provisional Ser. No. 61/686,017 filed Mar. 29, 2012 and titled "Downlight Fixtures," the contents of which are incorporated herein by reference.

FIELD OF THE INVENTION

Embodiments of the invention generally relate to a light assembly for recessed positioning within a ceiling.

BACKGROUND OF THE INVENTION

Conventional light engines for recessed positioning within a ceiling opening (referred to as downlight fixtures) may use light emitting diodes ("LEDs") or other suitable light sources. Because LEDs and other light sources give off thermal energy, heat sinks are sometimes incorporated into the fixture to facilitate heat dissipation from the light sources. The downlight fixture also typically includes one or more reflectors and one or more lenses that help diffuse and direct the light as desired. To alter the output and distribution of the light source (such as its beam angle, diffusing light pattern, color, etc.), the entire assembly must be removed, which is time consuming and cumbersome.

SUMMARY OF THE INVENTION

The terms "invention" "the invention," "this invention" and "the present invention" used in his patent are intended to refer broadly to all of the subject matter of this patent and the patent claims below. Statements containing these terms should not be understood to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential. features of the claimed subject matter, nor is it intended, to be used in isolation to determine the scope of the claimed subject matter. The subject matter should be understood by reference to the entire specification of this patent, all drawings and each claim.

In certain embodiments, a versatile recessed downlight fixture assembly is provided that allows for quick and easy customization of its light output and distribution without having to remove the entire fixture from an installation. In some embodiments, the fixture includes a threaded ring that cooperates with threads on the heat sink. The threaded ring supports and retains a lens and a reflector within the fixture and can be removed to allow for replacement of such components within the fixture.

BRIEF DESCRIPTION OF THE DRAWINGS

A full and enabling disclosure including the best mode of practicing the appended claims and directed to one of ordinary skill in the art is set forth more particularly in the remainder of the specification. The specification makes reference to the following appended figures, in which use of like reference numerals in different features is intended to illustrate like or analogous components.

DETAILED DESCRIPTION OF THE DRAWINGS

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Figure 1:
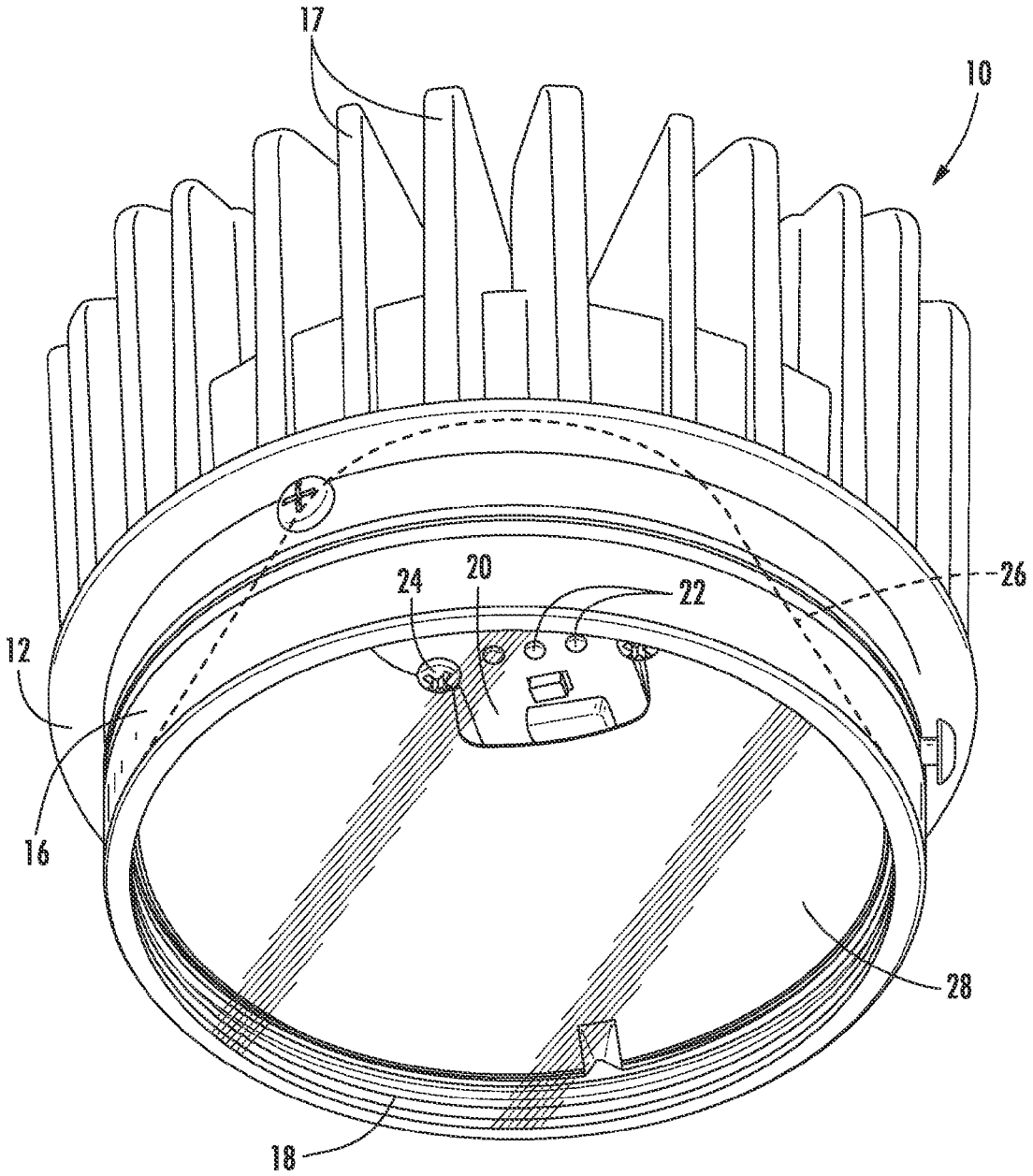
FIG. 1 is an assembled perspective view of a recessed downlight fixture according to one embodiment.
Figure 2:
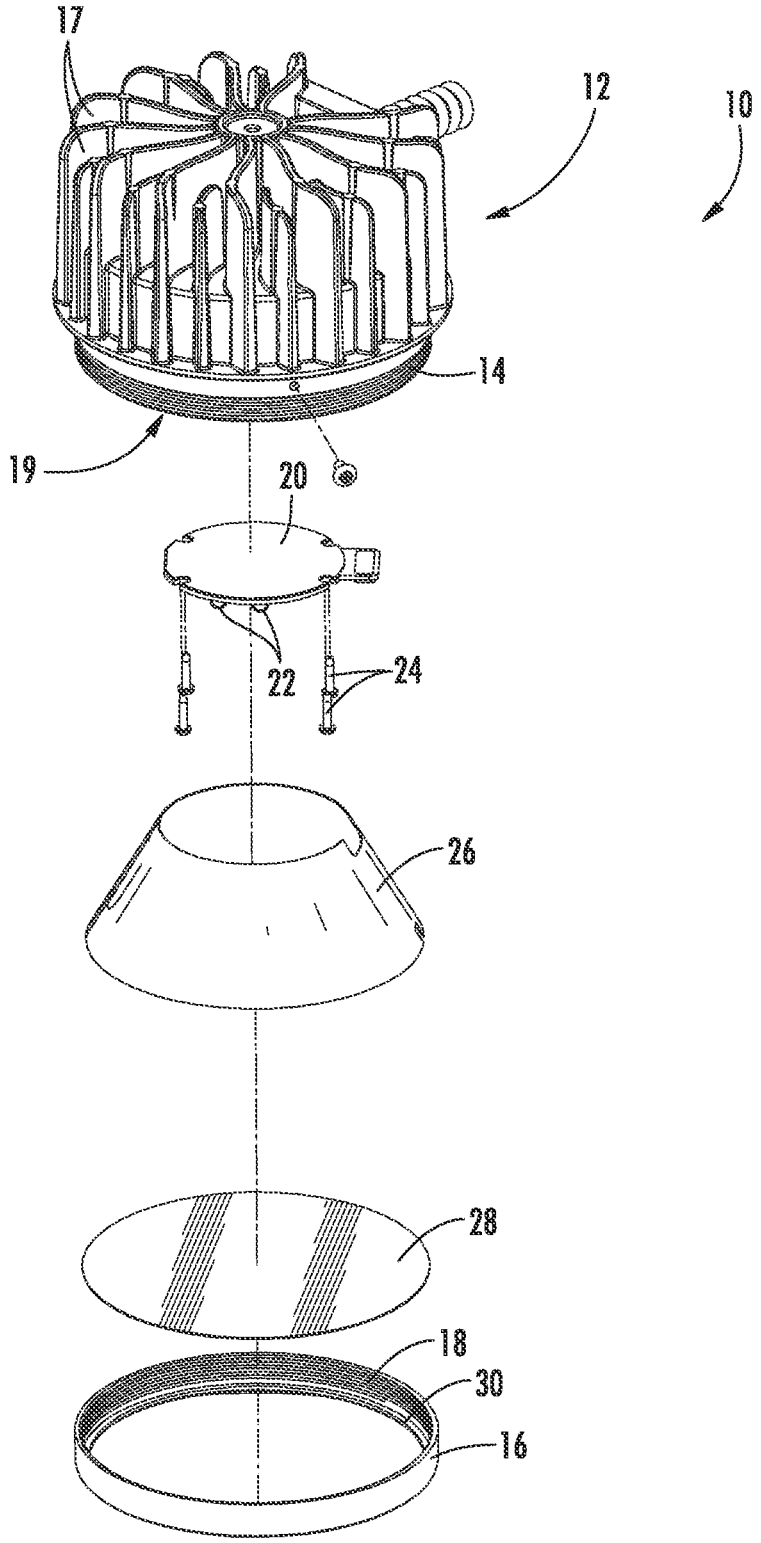
FIG. 2 is an exploded view of the downlight fixture of FIG. 1.

FIG. 1 illustrates an assembled recessed downlight fixture 10 according to one non-limiting embodiment of the invention. Downlight fixture 10 includes a heat sink 12 having a cavity 19 in which various fixture components are housed. Threads 14 are provided, around the periphery of one end of the heat sink 12 near the opening of cavity 19, as illustrated in FIG. 2. As illustrated, threads 14 are external threads, although they may be internal threads in other embodiments. A plurality of fins 17 may, but do not have to, radially project from the heat sink 12 to facilitate convective cooling of heat dissipated through heat sink 12. A light source, such as a printed circuit board 20 with LEDs 22 mounted thereon, is mounted to the heat sink 12 within the cavity 19, as illustrated in FIG. 1. In some embodiments, printed circuit board. 20 is mounted to heat sink 12 using a plurality of fasteners 24, although printed circuit board 20 may be mounted in any suitable manner (including without the use of external fasteners in some embodiments) within heat sink 12. Moreover, any suitable light source may be used in place of printed circuit board 20, including but not limited to a printed circuit board with chip-on-board technology or a fluorescent lamp.

An internal reflector 26 is positioned within the cavity 19 of the heat sink 12 (see FIGS. 1-2) and directs the light from LEDs 22 (or other suitable light source) downward at the desired beam angle. A lens 28 configured to impart a certain light distribution pattern on the area to be lit is positioned at or near the cavity opening of the heat sink 12.

Illustrated in FIGS. 1-2 is a ring 16 that includes threads 18 configured to engage with threads 14 of heat sink 12. As shown, threads 18 are internal threads, although they may be external threads in other embodiments (such as when threads 14 are internal). When mated with the heat sink 12, the ring 16 supports the lens 28 in the fixture 10, which in turn supports the reflector 26. In essence, the ring 16 retains the lens 28 and the reflector 26 in place within fixture 10. When the ring 16 is mated with the heat sink 12, at least a portion of the lens 28 (such as the periphery of the lens) rests against a lip 30 of the ring 16. Although ring 16 is illustrated in use with fixture 10, it is by no means limited to use in this particular fixture and may be used with any suitable fixture.

Use of the ring 16 allows for quick and easy customization of the light output and other optical properties of the fixture 10. For example, because lens 28 and reflector 26 are supported and secured within fixture 10 by ring 16, lens 28 and reflector 26 will fall out of the assembly (i.e., are no longer secured within fixture 10) when the threads 18 of ring 16 are unscrewed from the threads 14 of heat sink 12. In this way, lens 28 and/or reflector 26 can be easily replaced by unscrewing ring 16 without having to remove the entire fixture 10. In some embodiments, because the printed circuit board 20 and LEDs 22 mounted thereon are secured within heat sink 12 independent of the ring 16 (such as, for example, by fasteners 24 or otherwise), unscrewing of ring 16 does not cause the printed circuit board 20 to fall out of the fixture 10. Once the lens and the reflector are no longer secured within the fixture 10 such that they fall out of the fixture 10, one or both of the lens 28 and the reflector 26 can be replaced with another lens and/or reflector to alter the light output and/or light distribution of the generated light. For example, the beam angle, beam intensity, diffusing light pattern, light output, color, focusing, etc. may be adjusted in nearly any conceivable combination by replacing one or both of the lens and the reflector.

For example, a first lens imparting one light distribution pattern may be quickly replaced with a second lens imparting another light distribution pattern and/or color and/or beam intensities, etc. (such as but not limited to a second lens with a different thickness than the first lens) simply by unscrewing the ring 16, removing the first lens, replacing it with the second lens, and re-securing the threaded trim ring with the heat sink. Similarly, the reflector may also be quickly replaced with a second reflector (such as but not limited to a reflector with a different shape and/or height and/or profile than the first reflector) to provide a variety of beam intensities, colors, and/or angles, etc. In this way, the reflector and the lens can be customized and easily installed in the fixture, as well as easily replaced, without having the remove the entire fixture.

The foregoing is provided for purposes of illustrating, explaining, and describing embodiments of the present invention. Further modifications and adaptations to these embodiments will be apparent to those skilled in the art and may be made without departing from the scope or spirit of the invention. Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

I claim:

1. A light fixture comprising:

(a) a single piece housing and heat sink comprising a plurality of fins, the single piece housing and heat sink defining a cavity and a cavity opening and having a first set of threads extending at least partially around the single piece housing and heat sink at a first end of the single piece housing and heat sink proximate the cavity opening;

(b) a light source secured to the single piece housing and heat sink within the cavity;

(c) a reflector positioned within the cavity of the single piece housing and heat sink;

(d) a lens positioned so as to at least partially cover the cavity opening of the single piece housing and heat sink; and (e) a ring with a second set of threads configured to engage the first set of threads, wherein the ring supports and retains the lens and the reflector within the fixture.

2. The light fixture of claim 1, wherein the ring is separate from the reflector and the lens.

3. The light fixture of claim 1, wherein the lens and the reflector are retained within the fixture solely by the second set of threads of the ring engaging the first set of threads of the single piece housing and heat sink.

4. The light fixture of claim 1, wherein the plurality of fins extend parallel to an axial direction of the light fixture and radially project from the single piece housing and heat sink.

5. The light fixture of claim 1, wherein the light source is secured to the single piece housing and heat sink independent of the ring.

6. The light fixture of claim 1, wherein, when the second set of threads of the ring engages with the first set of threads of the single piece housing and heat sink, at least a portion of the lens rests against a lip of the ring.

7. The light fixture of claim 1, wherein the light source comprises a plurality of light emitting diodes.

8. The light fixture of claim 1, wherein the plurality of fins extend parallel to a vertical direction of the light fixture and radially project with a curved profile from the single piece housing and heat sink.

9. The light fixture of claim 1, wherein the plurality of fins extend parallel to an optical direction of the light fixture and radially project from the single piece housing and heat sink.

10. A method of installing a light fixture comprising:

providing a single piece housing and heat sink comprising a plurality of fins, the single piece housing and heat sink defining a cavity and a cavity opening and having a first set of threads extending at least partially around the single piece housing and heat sink at a first end of the single piece housing and heat sink proximate the cavity opening;

securing a light source to the single piece housing and heat sink within the cavity;

positioning an initial reflector within the cavity of the single piece housing and heat sink;

positioning an initial lens so as to at least partially cover the cavity opening of the single piece housing and heat sink; and mating threads of a ring with the threads of the single piece housing and heat sink to retain the initial reflector and the initial lens within the fixture.

11. The method of claim 10, further comprising removing at least one of the initial reflector or initial lens from the light fixture by disengaging the threads of the ring from the threads of the single piece housing and heat sink.

12. The method of claim 11, further comprising replacing the initial lens or initial reflector with at least one of a replacement lens or replacement reflector.

13. The method of claim 12, further comprising mating the threads of the ring with the threads of the single piece housing and heat sink to retain the at least one replacement reflector or replacement lens within the fixture.

14. The method of claim 11, wherein the initial lens or initial reflector is replaced without having to move the single piece housing and heat sink.

15. The method of claim 10, wherein the step of securing the light source to the single piece housing and heat sink comprises securing a printed circuit board with a plurality of light emitting diodes to the single piece housing and heat sink.

16. The method of claim 10, wherein the step of securing the light source to the single piece housing and heat sink secures the light source to the single piece housing and heat sink independent of the mating of the ring with the single piece housing and heat sink.

* * * * *